US009682595B2

(12) United States Patent
Zimdahl et al.

(10) Patent No.: US 9,682,595 B2
(45) Date of Patent: Jun. 20, 2017

(54) PAINT CONTAINER

(71) Applicant: Allen Patrick Zimdahl, Parkerville (AU)

(72) Inventors: Allen Patrick Zimdahl, Parkerville (AU); Edward Joseph Khoury, Bateman (AU)

(73) Assignee: Allen Patrick Zimdahl, Parkerville (AU)

( * ) Notice: Subject to any disclaimer, the term of this patent is extended or adjusted under 35 U.S.C. 154(b) by 0 days.

(21) Appl. No.: 14/767,886

(22) PCT Filed: Feb. 13, 2014

(86) PCT No.: PCT/AU2014/000116
§ 371 (c)(1),
(2) Date: Aug. 13, 2015

(87) PCT Pub. No.: WO2014/124488
PCT Pub. Date: Aug. 21, 2014

(65) Prior Publication Data

US 2016/0001589 A1 Jan. 7, 2016

(30) Foreign Application Priority Data

Feb. 14, 2013 (AU) ..... 2013900468

(51) Int. Cl.
*B44D 3/12* (2006.01)
*B65D 21/02* (2006.01)
(Continued)

(52) U.S. Cl.
CPC ..... *B44D 3/128* (2013.01); *B44D 3/12* (2013.01); *B65D 21/0209* (2013.01);
(Continued)

(58) Field of Classification Search
CPC ..... B44D 3/12; B44D 3/128; B65D 21/0209; B65D 21/0233; B65D 21/062; B65D 25/20
(Continued)

(56) References Cited

U.S. PATENT DOCUMENTS 304,291 A * 9/1884 Brien ..... B65D 25/20 220/698
332,043 A * 12/1885 Brien ..... B65D 25/20 220/698

(Continued)

*Primary Examiner* — Fenn Mathew
*Assistant Examiner* — Elizabeth Volz
(74) *Attorney, Agent, or Firm* — Tope-McKay & Associates

(57) ABSTRACT

A paint container (10) comprising a main body (12) for receiving paint wherein the main body comprises a side wall (16) and an outwardly tapering rim portion (18) at an upper end of the side wall (16). A tubular member (14) is provided, a lower end of which is receivable within the rim portion (18). First connectors (26) are provided on an outer surface of the tubular member (14) and second connectors (27) are provided on an inner surface (30) of the rim portion (18). Each of the first connectors (26) engages with a corresponding one of the second connectors (27) such that the tubular member (14) is supported within the rim portion (18) to define an annular aperture between the lower end of the tubular member (14) and the main body (12) of the paint container (10).

20 Claims, 14 Drawing Sheets

(51) Int. Cl.
*B65D 21/06* (2006.01)
*B65D 25/20* (2006.01)

(52) U.S. Cl.
CPC ..... *B65D 21/0233* (2013.01); *B65D 21/062* (2013.01); *B65D 25/20* (2013.01)

(58) Field of Classification Search
USPC ..... 220/698, 701, 702, 762, 764, 700, 699, 220/695, 4.03
See application file for complete search history.

(56) References Cited

U.S. PATENT DOCUMENTS

| | | | | | |
|---|---|---|---|---|---|
| 2,668,635 | A * | 2/1954 | Bennett | B44D 3/128 | 206/527 |
| 2,873,881 | A * | 2/1959 | Nichols | B65D 25/48 | 220/4.03 |
| 4,279,355 | A * | 7/1981 | Schwartz | B65D 50/061 | 215/222 |
| 4,316,560 | A * | 2/1982 | Carter | B44D 3/128 | 220/700 |
| 4,964,527 | A * | 10/1990 | Martin | B44D 3/128 | 220/4.03 |
| 6,062,389 | A * | 5/2000 | Kent | B44D 3/12 | 15/257.05 |
| 7,428,977 | B2 * | 9/2008 | Fera | B44D 3/128 | 220/699 |
| 7,565,985 | B2 * | 7/2009 | Lucey | B44D 3/128 | 220/23.87 |
| 2002/0139807 | A1 * | 10/2002 | Lucey | B44D 3/128 | 220/698 |

* cited by examiner

SECTION B-B

PAINT CONTAINER

FIELD OF THE INVENTION

The present invention relates to a container to be used for holding paint while painting.

BACKGROUND TO THE INVENTION

When painting with a brush, it is common to pour paint from a tin into a smaller container which can be carried around. While painting, the sides of the brush are often wiped on the edges of the container, in order to remove excess paint. While the aim is that this excess paint runs back into the inside of the container, there is often some amount of paint which ends up flowing down the outside of the container. This can therefore result in paint spills, through drips or from the outside of the container contacting nearby objects or the ground.

Paint containers having a channel around the rim to collect the paint that runs outside the rim have been proposed. Such containers include holes in the channel so that paint can run back into the inside of the container. These holes may however become blocked over time. Also, the arrangement can be difficult to clean due to the spaces in which paint may collect during use.

The present invention relates to an improved paint container aimed at overcoming, at least in part, the abovementioned problems.

SUMMARY OF THE INVENTION

According to one aspect of the present invention there is provided a paint container comprising:

a main body for receiving paint, the main body comprising a side wall and an outwardly tapering rim portion at an upper end of the side wall;

a tubular member, a lower end of which is receivable within the rim portion;

first connectors provided on an outer surface of the tubular member; and second connectors provided on an inner surface of the rim portion;

wherein each of the first connectors engage with a corresponding one of the second connectors such that the tubular member is supported within the rim portion to define an annular aperture between the lower end of the tubular member and the main body of the paint container.

Preferably the first connectors engage with the second connectors by movement of the tubular member towards the main body in a direction perpendicular to a central longitudinal axis of the main body.

In one embodiment, the first connectors comprise female connectors and the second connectors comprise male connectors such that the first connectors include openings into which the second connectors are received by movement of the tubular member towards the main body.

In a further embodiment, the second connectors comprise female connectors and the first connectors comprise male connectors such that the second connectors include openings into which the first connectors are received by movement of the tubular member towards the main body.

In a preferred embodiment, the first connectors each comprise a protruding portion including a vertical channel therein open at a lower end and the second connectors each comprise projections extending vertically upward such that the projections are received into lower ends of the channels as the tubular member is moved downwardly into the rim portion.

Preferably the projections include lugs on sides thereof adjacent the central longitudinal axis of the main body and the tubular member is provided with corresponding holes located within each of the channels such that the lugs engage into the holes to locate the tubular member relative to the main body.

In a further embodiment, the second connectors each comprise a protruding portion including a vertical channel therein open at an upper end and the second connectors each comprise projections extending downward such that the projections are received into upper ends of the channels as the tubular member is moved downwardly into the rim portion.

Preferably the projections extend downwardly from an associated cover portion, the cover portions comprising a planar member extending outwardly from the outer surface of the tubular member such that the cover member extends over the upper end of the channel.

In a preferred embodiment, the main body comprises a cylindrical vessel and the tubular member comprises a cylindrical member having a diameter such that the cylindrical member can be received in the opening defined by the rim portion.

In a preferred embodiment, the rim portion tapers outwardly from adjacent a lower end thereof to the adjacent an upper end thereof to a greater degree than the taper of the cylindrical side wall.

Preferably the cylindrical member is of the same diameter as that of the main body adjacent the rim portion.

Preferably an outer diameter of the main body adjacent the lower end is less than an inner diameter of the cylindrical member such that multiple paint containers may be placed in a stacked configuration.

In a preferred embodiment, the cylindrical member is received within the rim portion such that the lower end of the cylindrical member is located adjacent the lower end of the rim portion and an upper end of the cylindrical member is located above the upper end of the rim portion.

Preferably the first and second connectors are located at equal angular spacings around the tubular member and the rim portion.

In one embodiment, a handle is provided being connectable to the main body of the paint container and the rim portion is provided with securing members on outer sides thereof to engage with the handle such that the handle may be supported in one or more angular positions relative to the main body.

The securing members preferably include a pair of first protrusions located adjacent the upper edge of the rim portion above the connection between the handle and the rim portion such that the handle may be engaged between the first pair of protrusions to locate the handle in a vertical position.

A pair of second protrusions may be provided, one on either side of the pair of first protrusions, such that the handle engages with either of the second protrusions to hold the handle at an angle between vertical and horizontal.

BRIEF DESCRIPTION OF THE DRAWINGS

The invention will now be described, by way of example, with reference to the following drawings, in which:

FIG. 3*a* is an exploded view of the paint container of FIG. 1;

DETAILED DESCRIPTION OF PREFERRED EMBODIMENTS

Figure 1B:
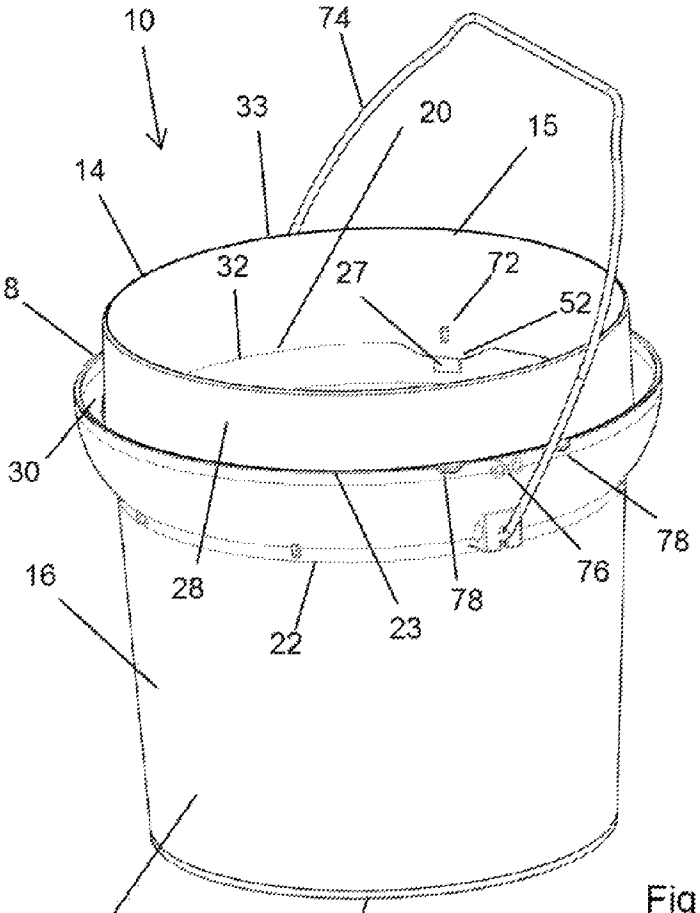
FIG. 1*b* in an upper perspective view of the paint container of FIG. 1*a* with the handle is an angled position.

Referring to Figures, there is shown a paint container 10 comprising a main body 12 and a tubular member 14. The main body 12 in the embodiment shown is a generally cylindrical vessel being closed at a lower end thereof. The main body 12 comprises a cylindrical side wall 16 having a base wall 17 extending across a lower end thereof and a rim portion 18 at an upper end thereof. The side wall 16 may include a slight tapered shape such that the diameter thereof adjacent the base wall 17 is less than the diameter adjacent the upper end thereof. The rim portion 18 defines an opening 20 into which paint can be poured for use when painting with a brush.

The rim portion 18 of the main body 12 tapers outwardly from a lower end 22 thereof to an upper end 23 thereof such that cross sections of the rim portion 18 taken perpendicular to the longitudinal axis of the main body 12 increase in area from the lower end 22 to the upper end 23. The rim portion 18 tapers outwardly from adjacent the lower end 22 to the upper end 23 to a greater degree than the taper of the side wall 16.

The tubular member 14 in the embodiment shown comprises a cylindrical member 15 having a diameter such that the cylindrical member 15 can be received in the opening 20 defined by the rim portion 18. The cylindrical member 15 is received within the rim portion 18 such that a lower end 32 of the cylindrical member 15 is located adjacent the lower end 22 of the rim portion 18 and an upper end 33 of the cylindrical member 15 is located above the upper end 23 of the rim portion 18.

The lower end 32 of the cylindrical member 15 is supported such that an annular aperture is defined between the cylindrical member 15 and the rim portion 18.

The cylindrical member 15 is separate from the main body 12 and is attachable to the main body 12. The cylindrical member 15 is supported relative to the rim portion 18 by a plurality of first connectors 26 located around an outer surface 28 of the cylindrical member 15 and a plurality of second connectors 27 located around an inner surface 30 of the rim portion 18. The second connectors 27 are provided at locations such that each of the first connectors 26 can be engaged with a corresponding second connector 27 when the cylindrical member 15 is inserted into the rim portion 18 of the main body 12.

The first connectors 26 engage with the second connectors 27 by movement of the cylindrical member 15 towards the main body 12 parallel to a central longitudinal axis of the main body 12.

Figure 1A:
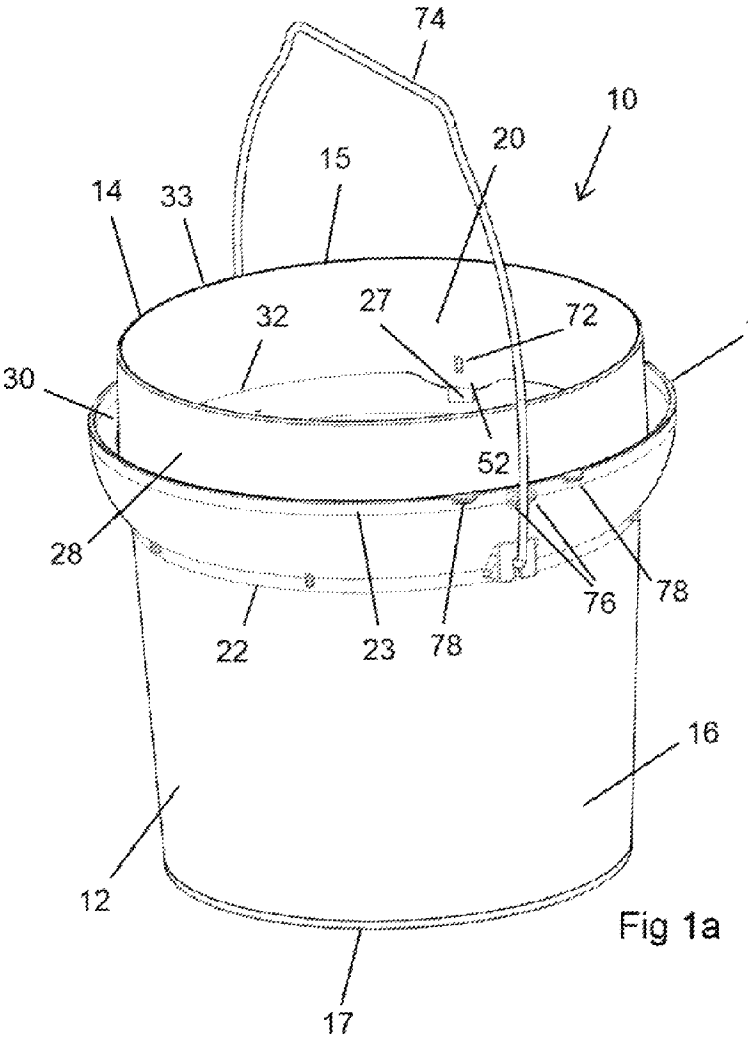
FIG. 1*a* is an upper perspective view of a paint container in accordance with the present invention.
Figure 2B:
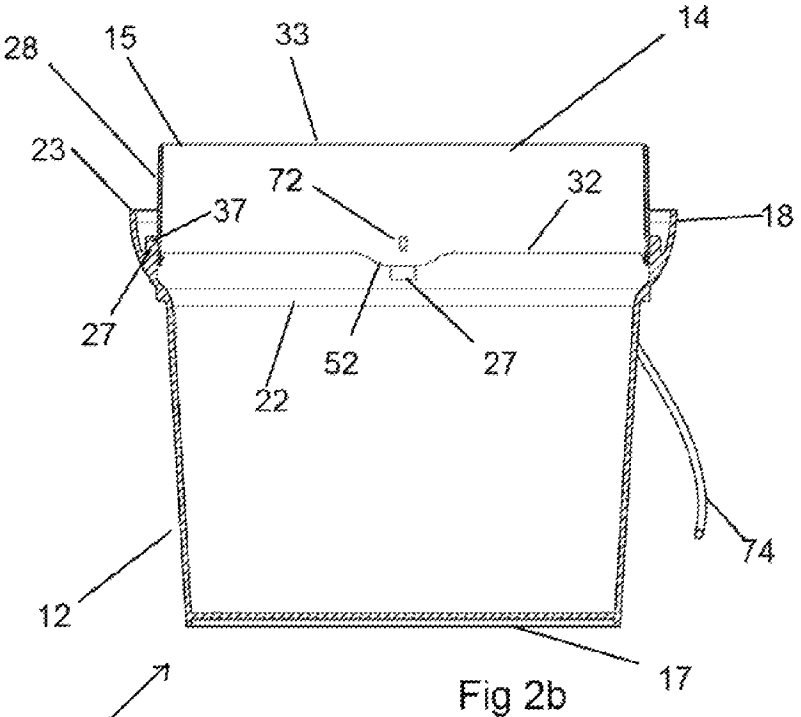
FIG. 2*b* is a cross sectional view of the paint container of FIG. 2*a* through the line B-B.
Figure 2A:
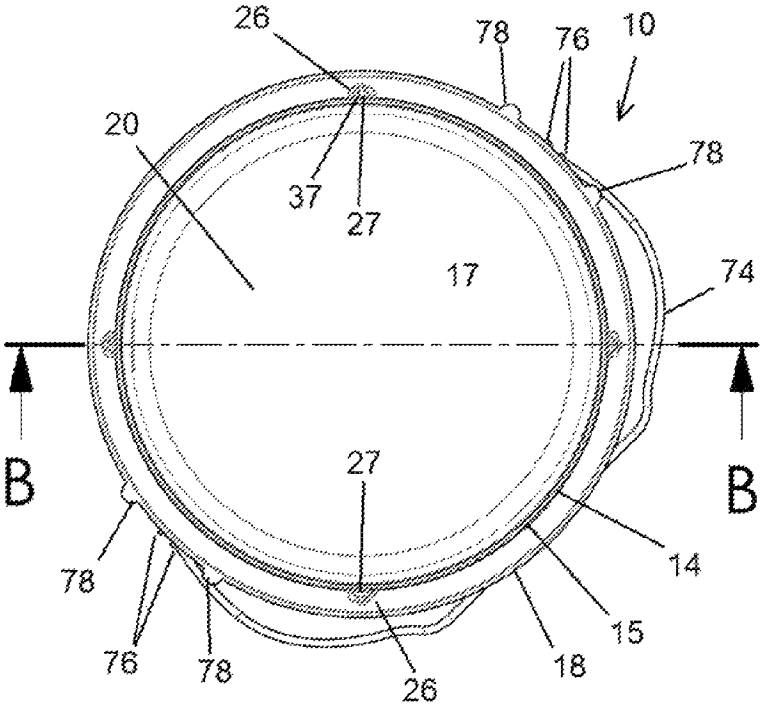
FIG. 2*a* is top view of the paint container of FIG. 1.

In the embodiment of FIGS. 1 to 3, the first connectors 26 comprise female connectors and the second connectors 27 comprise male connectors. The first connectors 26 therefore include openings into which the second connectors 27 are received by movement of the cylindrical member 15 towards the main body 12 such that the cylindrical member 15 is supported relative to the main body 12.

The first connectors 26 each comprise a protruding portion extending from the outer surface 28 of the cylindrical member 15 including a channel 36 therein. The protruding portions are located at equal angular spacings around the periphery of the cylindrical member 15. The channels 36 extend parallel to the central longitudinal axis of the cylindrical member 15 and include open lower ends. The second connectors 27 each comprise projections 37 located at equal angular spacings around the inner surface 30 of the rim portion 18. The projections 37 extend vertically upward such that the projections 37 extend parallel to the central longitudinal axis of the main body 12. The projections 37 are located such that the projections 37 may be received into lower ends of the channels 36 as the cylindrical member 15 is moved downwardly into the rim portion 18.

The projections 37 are provided with lugs 70 on sides thereof adjacent the central longitudinal axis of the main body 12 of the paint container 10. The cylindrical member 15 is provided with corresponding holes 72 located within each of the channels 36 such that the holes 72 extend from the outer surface 28 of the cylindrical member 15 to an inner surface thereof. When the projections 37 are received in the channels 36, the lugs 70 engage into the holes 72 to locate the cylindrical member 15 relative to the main body 12 of the paint container 10.

The lower edge of the cylindrical member 15 includes a plurality of the extending portions 52. Each of the extending portions 52 extend downwardly below the lower edge 33 of the cylindrical member 15. Each of the first connectors 26 is located on one of the extending portions 52.

A handle 74 is provided being connectable to the main body 12 of the paint container 10 such that the paint container 10 may be supported by the handle 74. The handle 74 comprises a curved elongate member having opposed ends thereof secured to the outer surface of the main body 12 adjacent the lower end 22 of the rim portion 18.

The rim portion 18 is provided with securing members on outer sides thereof to engage with the handle 74 such that the handle 74 may be supported in one or more angular positions relative to the main body 12. In the embodiment shown, the securing members include a pair of first protrusions 76 located adjacent the upper edge 23 of the rim portion 18 above the connection between the handle 74 and the rim portion 18. The handle 74 may be rotated such that the handle 74 engages between the first pair of protrusions 74 to locate the handle 74 in a vertical position (as shown in FIG. 1*a*). A pair of second protrusions 78 is also provided, one on either side of the pair of first protrusions 76. The handle 74 engages with either of the second protrusions 78 to hold the handle 74 at an angle between vertical and horizontal (as can be seen in FIG. 1*b*).

In use, the cylindrical member 15 is supported within the rim portion 18 to define the annular aperture between the cylindrical member 15 and the main body 12. As the upper end 33 of the cylindrical member 15 extends above the upper end 23 of the rim portion 18, excess paint can be removed from a paint brush by wiping across the upper end 33 of the cylindrical member 15. Paint will run down the inner surface of the cylindrical member 15 and back into the main body 12. The cylindrical member 15 is dimensioned to be of the same diameter as that of the main body 12 adjacent the rim portion 18 to allow paint to run directly down the inside wall of the main body 12.

Any paint running down the outer surface of the cylindrical member 15 will simply pass through the annular aperture back into the main body 12. As this aperture is annular in shape extending around the entire rim portion 18, there is reduced chance of paint obstructing the aperture. As the cylindrical member 15 is a separate element, it may be removed from the main body 12 by disconnection of the first and second connectors 26 and 27 to allow easy cleaning of both itself and the main body 12.

Figure 3B:
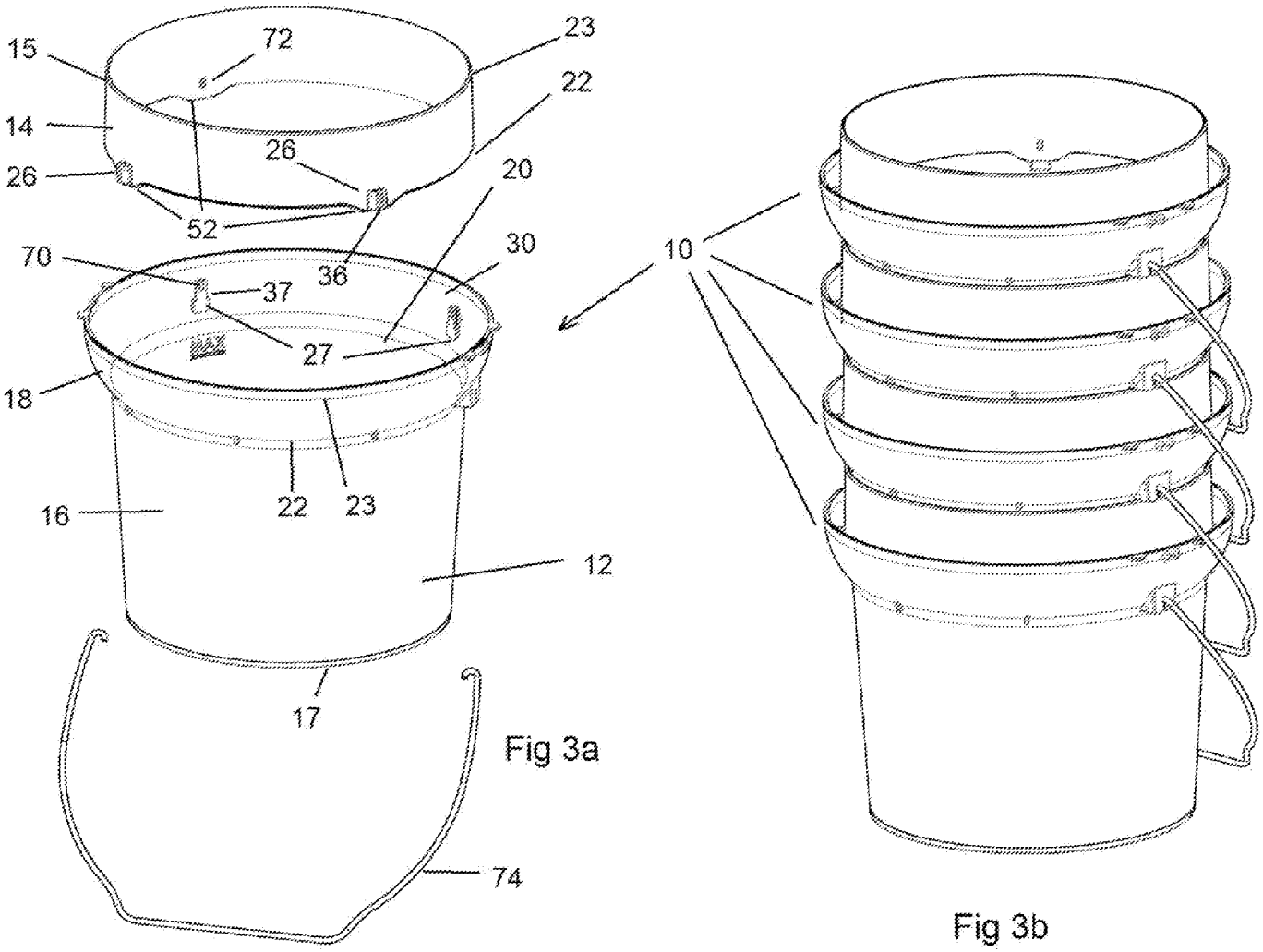
FIG. 3*b* is an upper perspective view of a plurality of the paint containers of FIG. 1 in a stacked configuration.
Figure 4B:
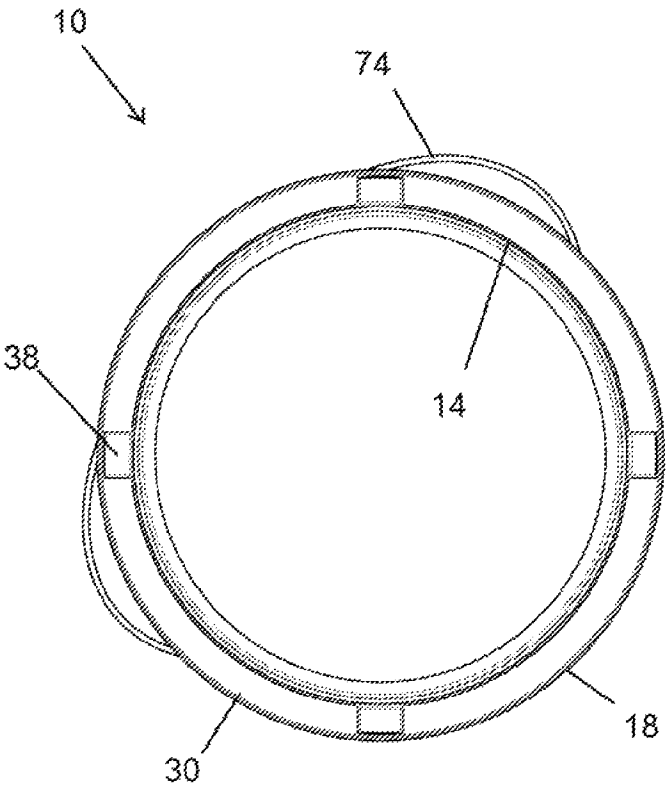
FIG. 4*b* is a top view of the paint container of FIG. 4*a;*
Figure 4A:
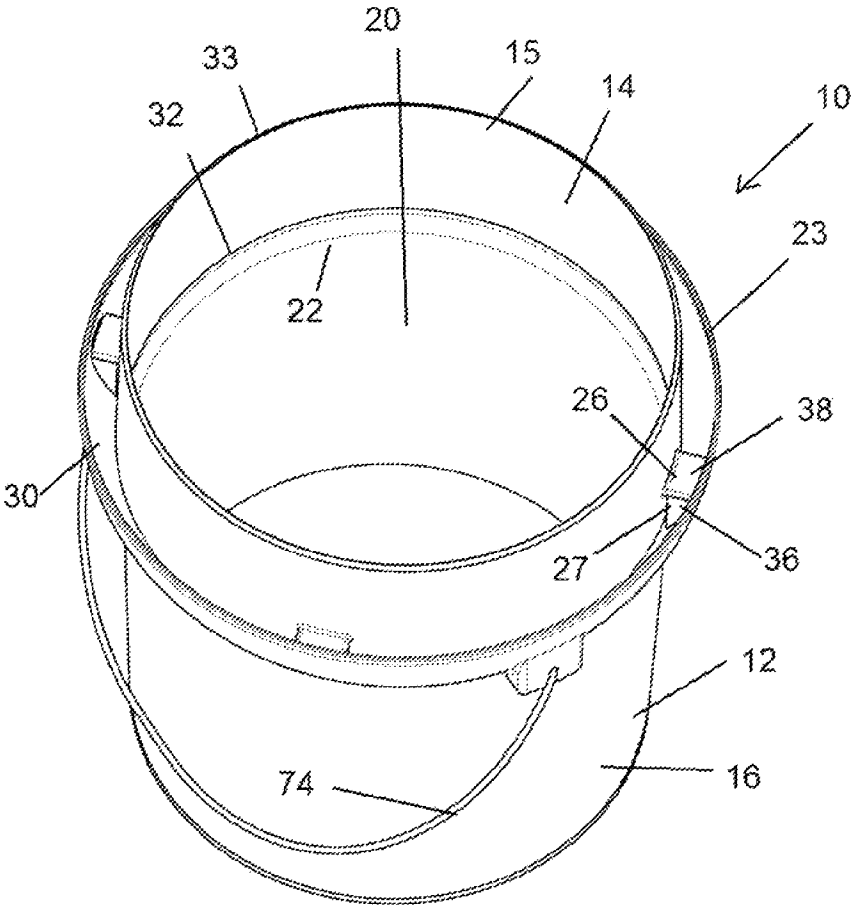
FIG. 4*a* is an upper perspective view of a second embodiment of a paint container in accordance with the present invention.
Figure 5:
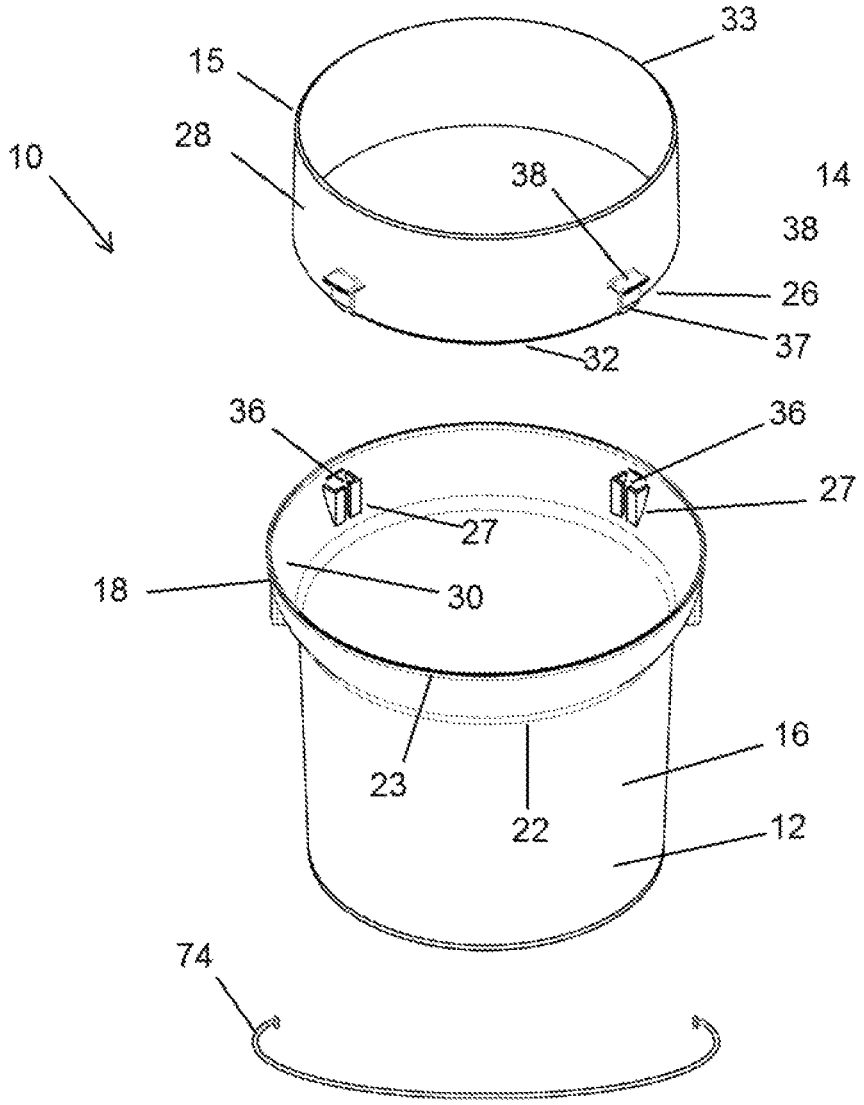
FIG. 5 is an exploded view of the paint container of FIG. 4.
Figure 6B:
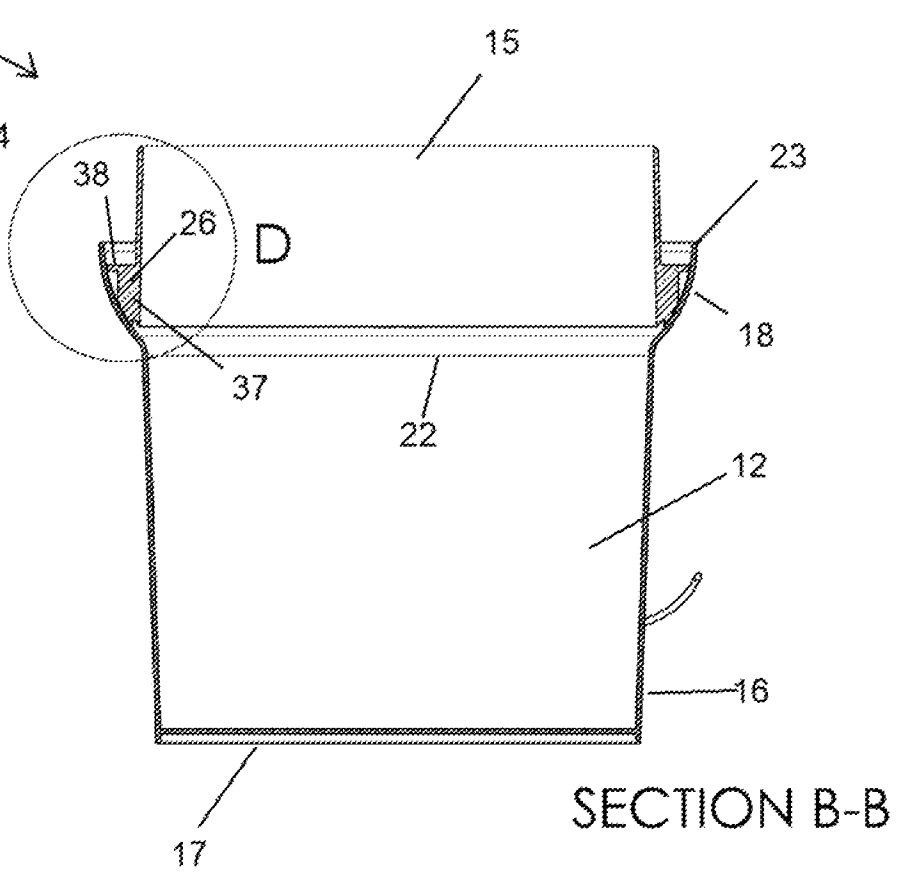
FIG. 6*b* is a cross sectional view of the paint container of FIG. 6*a* through the line B-B.
Figure 6A:
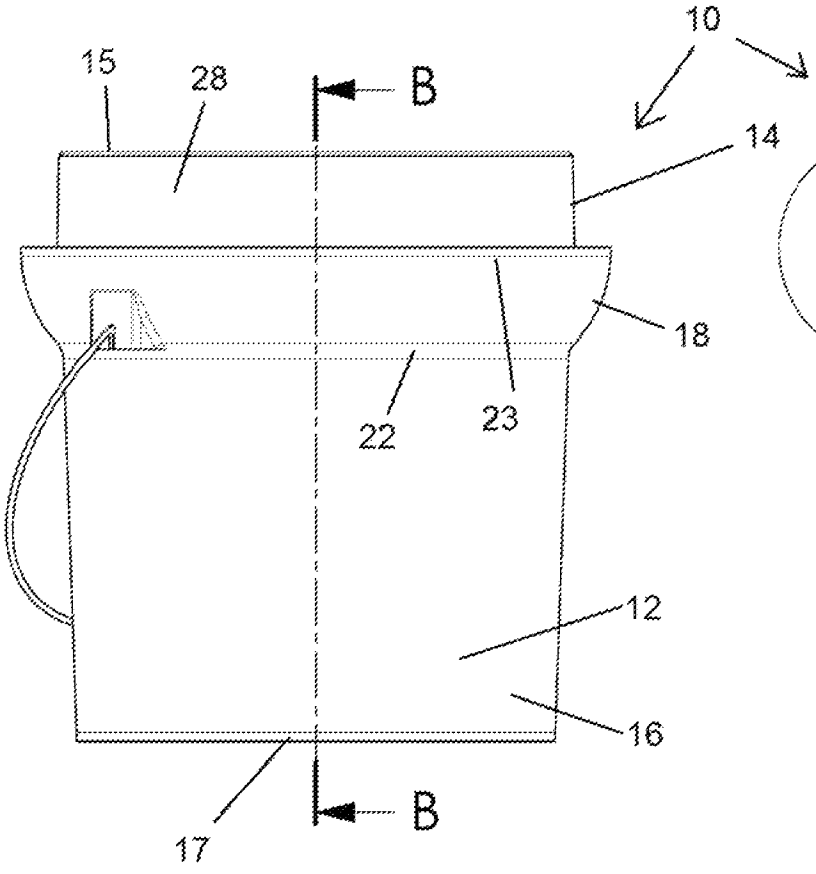
FIG. 6*a* is a side view of the paint container of FIG. 4.
Figure 7:
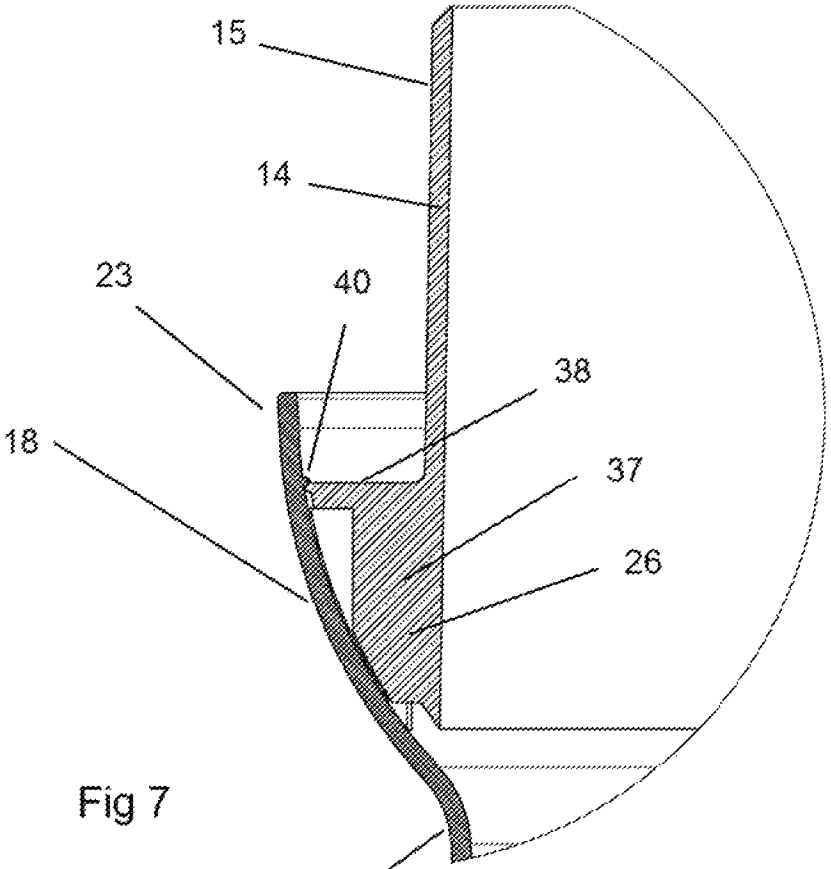
FIG. 7 is a close up view of Detail D of FIG. 6*b;*
Figure 8:
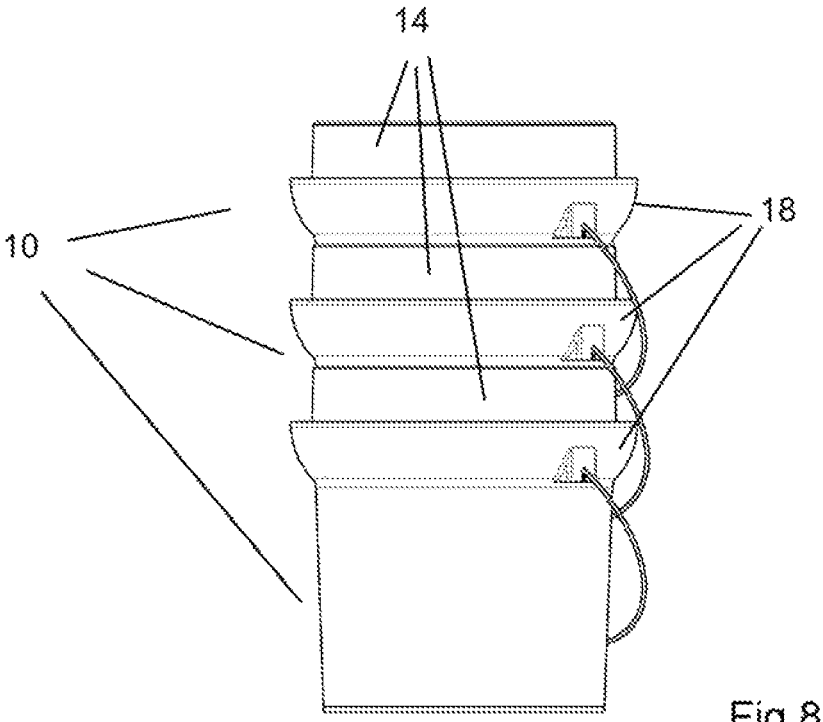
FIG. 8 is a side view of a plurality of the paint containers of FIG. 4 in a stacked configuration.

The outer diameter of the main body 12 adjacent the lower end is less than the inner diameter of the cylindrical member 15. Multiple paint containers 10 may therefore be placed in a stacked configuration, as shown in FIGS. 3*b* and 8, for transport and/or storage.

FIGS. 4 to 8 show a second embodiment of a paint container 10 in accordance with the present invention. The paint container of FIGS. 4 to 8 is similar to the paint container 10 of FIGS. 1 to 3 and like reference numerals are used to denote like parts.

In the embodiment of FIGS. 4 to 8, the second connectors 27 each comprise protruding portions defining a channel 36 being open at an upper end thereof. Each of the first connectors 26 comprises a projection 37 which can be received downwardly into the channel 36. Each projection 37 extends downwardly from an associated cover portion 38. Each cover portion 38 comprises a planar member extending outwardly from the outer surface 28 of the cylindrical member 15. The projections 37 extend downwardly from a lower surface of the cover portion 38 such that a gap exists between the projection 37 and the outer surface of the cylindrical member 15. The cover portion 38 is provided such that it extends over the upper end of the channel 36 to prevent paint running into the channel 36.

The channels 36 and the projections 37 are generally rectangular in cross sectional shape. Also, each channel 36 is provided with a rib 40 which engages with a distal end of the cover portion 38 when the cylindrical member 15 is in place. The ribs 40 engage with the cover portions 38 to secure the cylindrical member 15.

Figure 9:
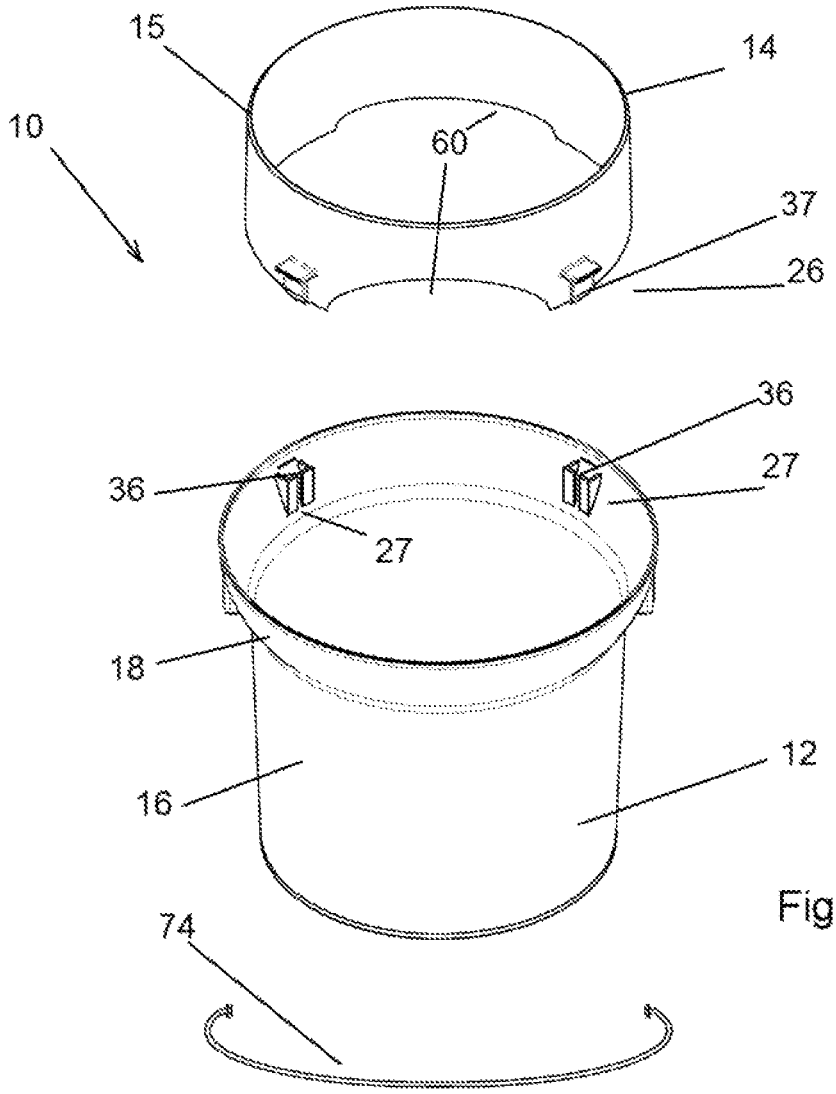
FIG. 9 is an exploded view of a third embodiment of a paint container ire accordance with the present invention.

FIG. 9 shows a third embodiment of a paint container 10 in accordance with the present invention. The paint container 10 of FIG. 9 is similar to the embodiment of FIGS. 4 to 8 and like reference numerals are used to denote like parts. The paint container 10 of FIG. 9 includes cut out portions 60 in the lower end 32 of the cylindrical member 15. The cut out portions 60 in the embodiment shown are provided on opposed sides of the cylindrical member 15 and are arcuate in shape. The cut out portions 60 are provided to allow additional space for paint to be poured back out of the paint container 10 into a paint tin.

Figure 10:
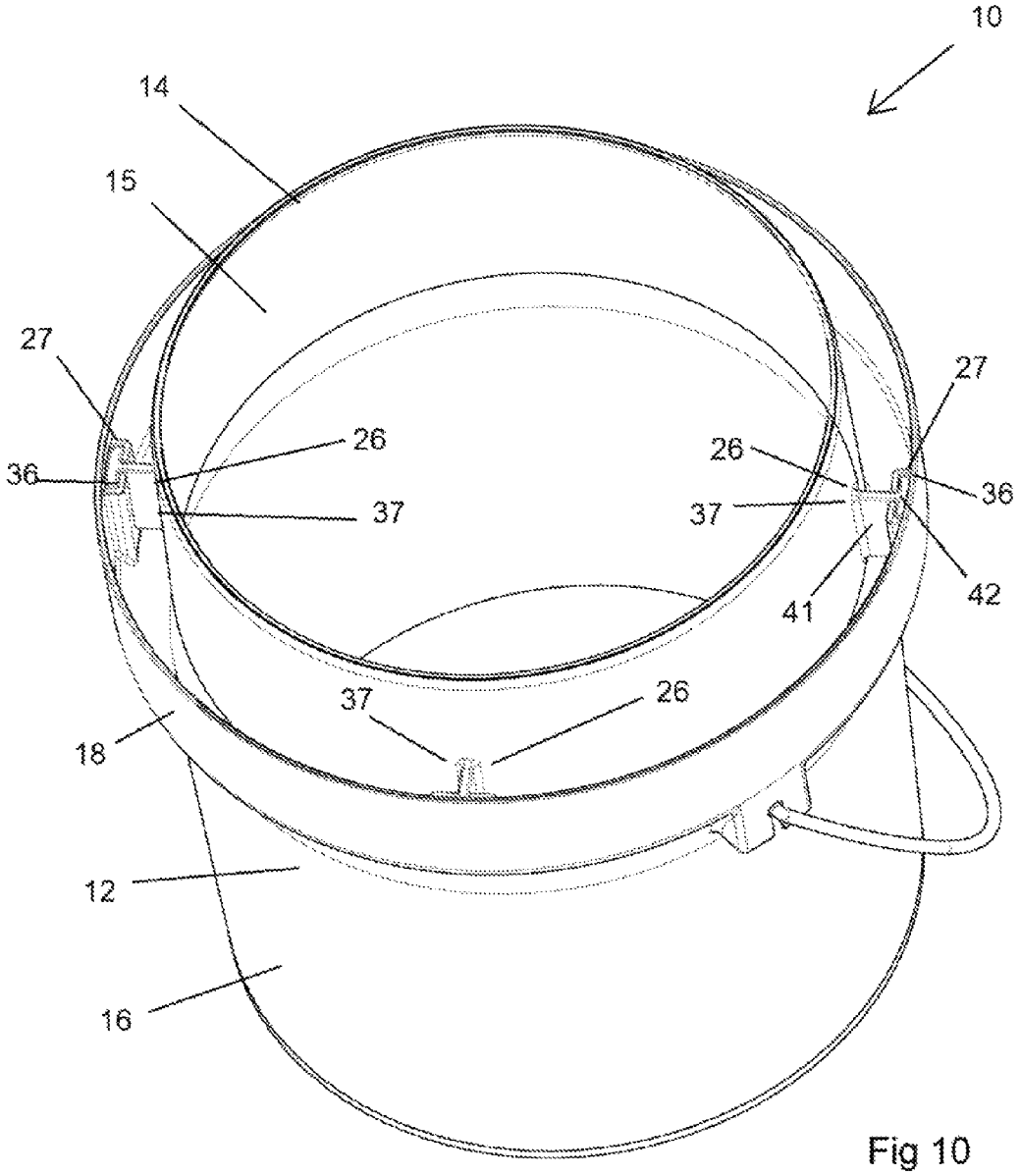
FIG. 10 is an upper perspective view of a fourth embodiment of a paint container in accordance with the present invention.
Figure 11B:
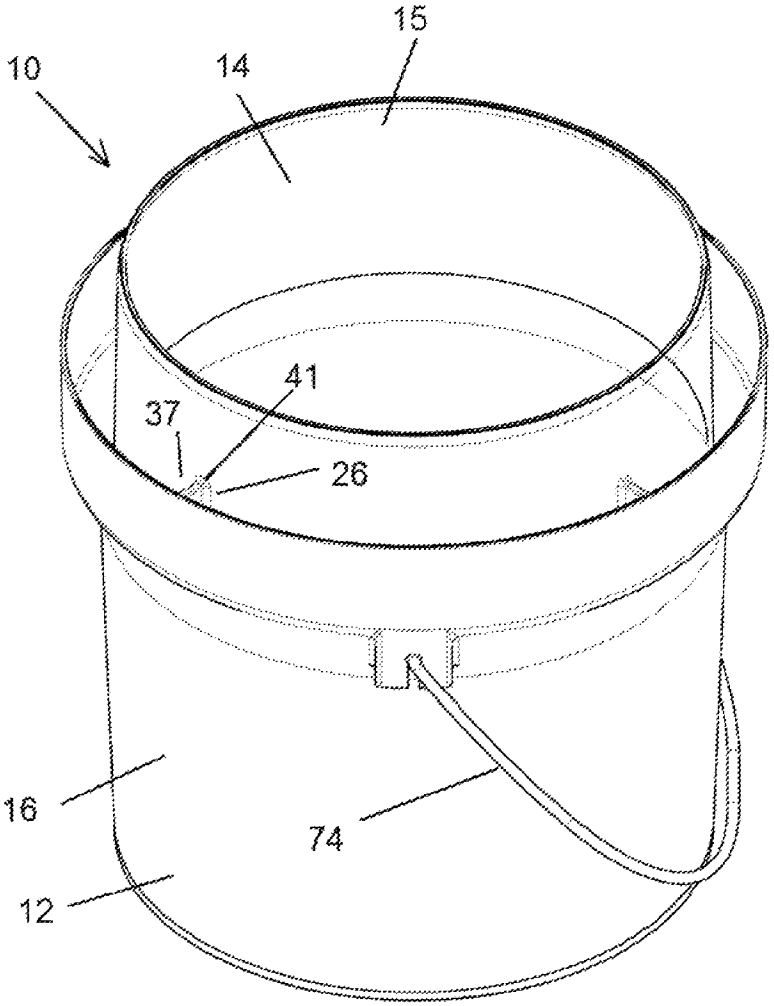
FIG. 11*b* is a further upper perspective view of the paint container of FIG. 10.
Figure 11A:
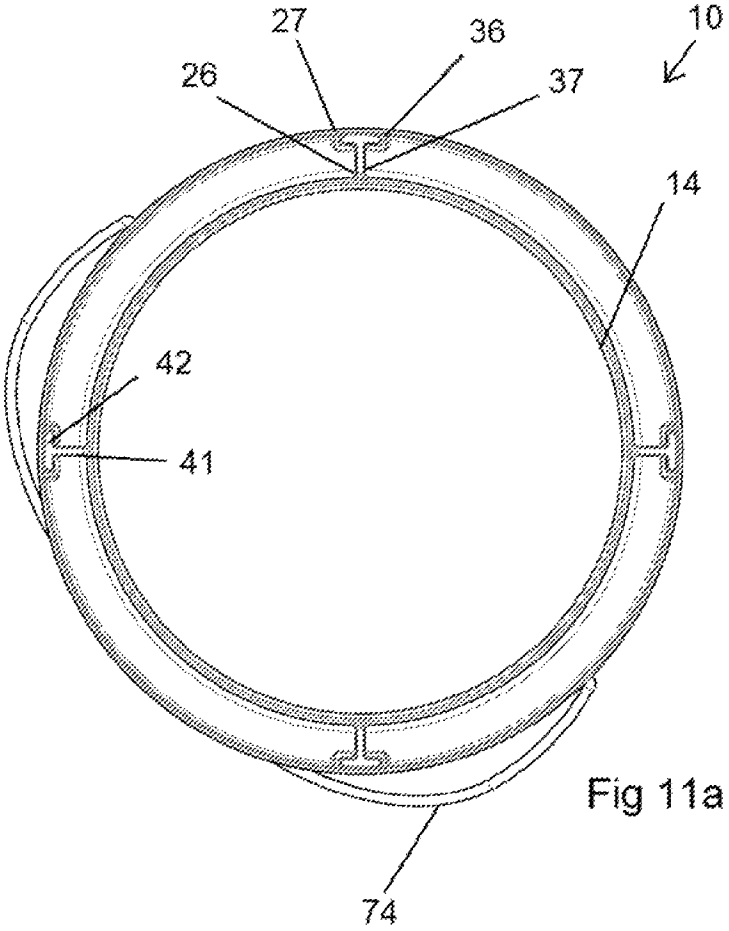
FIG. 11*a* is a top view of the paint container of FIG. 10.
Figure 12B:
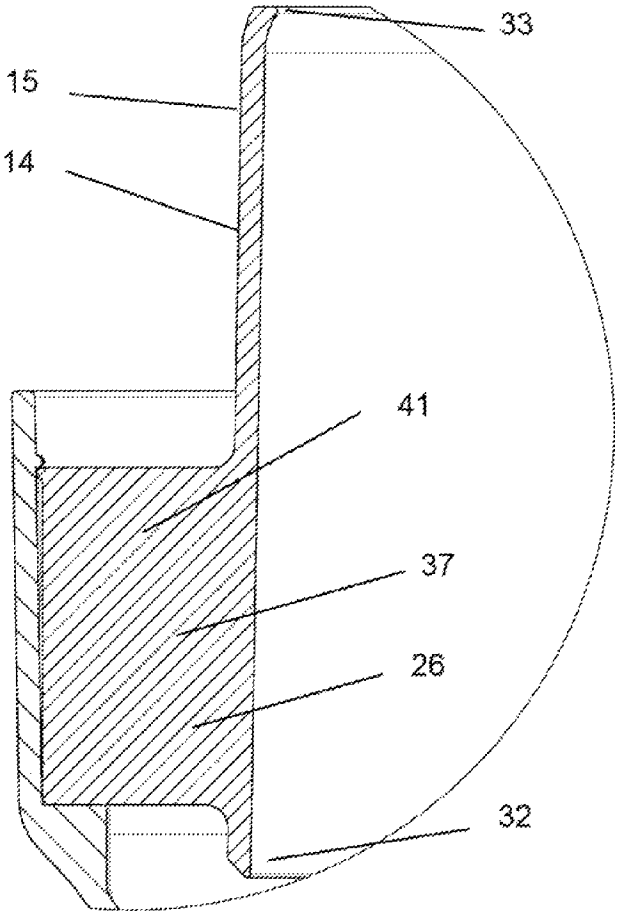
FIG. 12*b* is a close up view of the connection between the tubular member and the main body of the paint container of FIG. 12*a* through the line B-B.
Figure 12A:
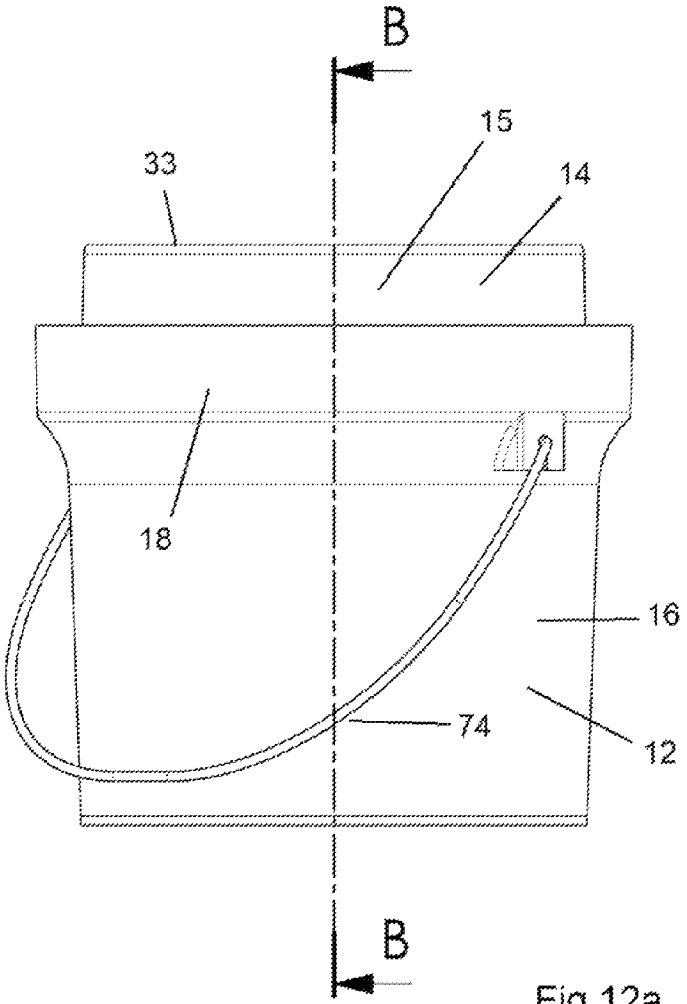
FIG. 12*a* is a side view of the paint container of FIG. 10.

FIGS. 10 to 12 show a fourth embodiment of a paint container 10 in accordance with the present invention. The paint container 10 of FIGS. 10 to 12 is similar to the embodiment of FIGS. 4 to 8 and like reference numerals are used to denote like parts. The first and second connectors 26 and 27 of the fourth embodiment comprise projections 37 and channels 36 respectively but differ from the second embodiment in shape. In the embodiment of FIGS. 10 to 12, the first connectors 26 each comprise a projection 37 having a T-shaped cross section. A base portion 41 of the projection 36 is received through a slot provided in the channel 36 and an end portion 42 is received within the channel 36 to retain the cylindrical member 15.

Figure 13B:
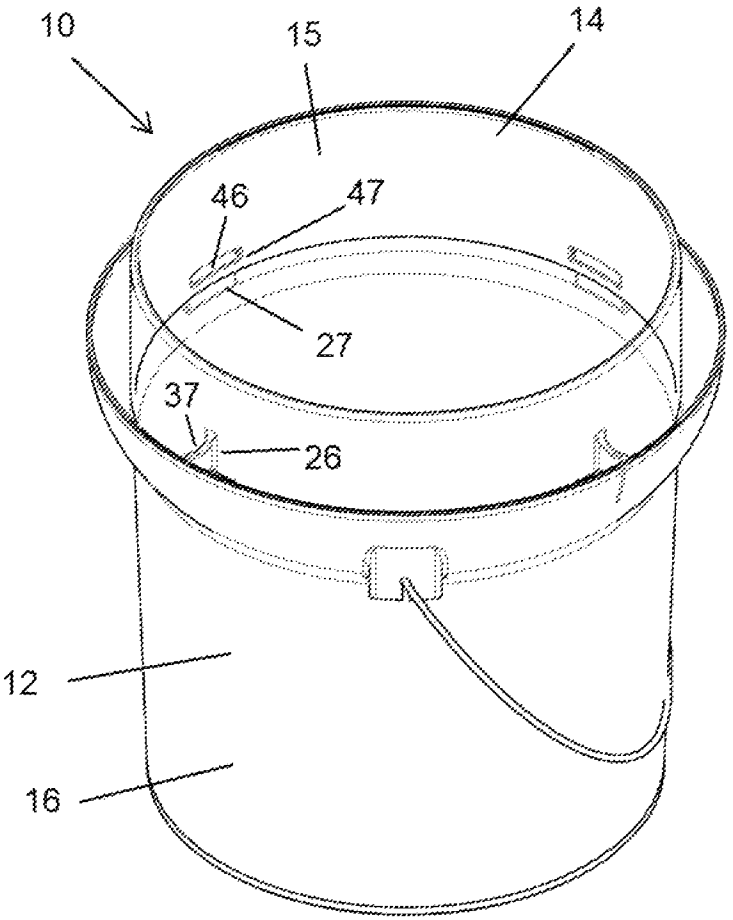
FIG. 13*b* is an upper perspective view of the paint container of FIG. 13*a;*
Figure 13A:
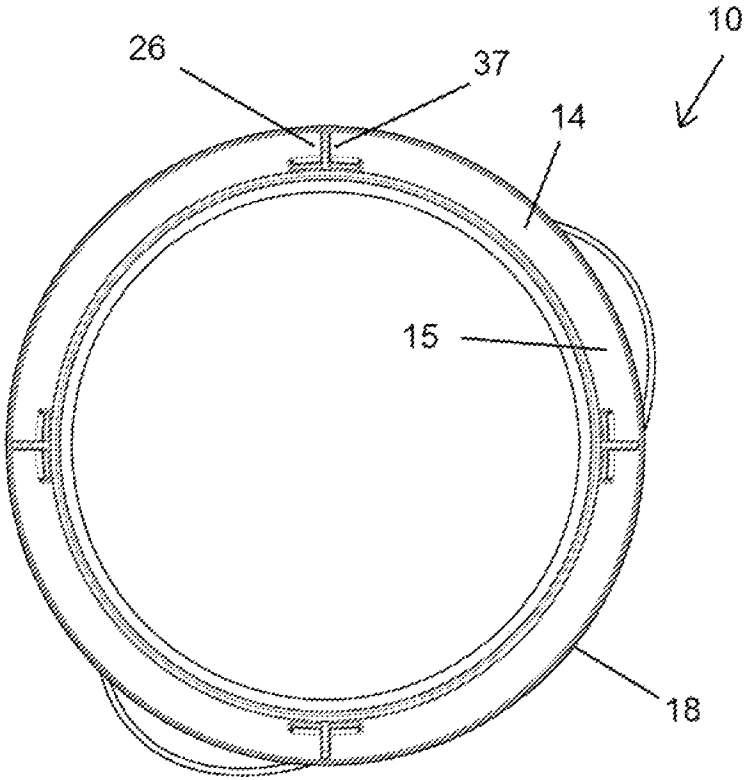
FIG. 13*a* is a top view of a fifth embodiment of a paint container accordance with the present invention.
Figure 14B:
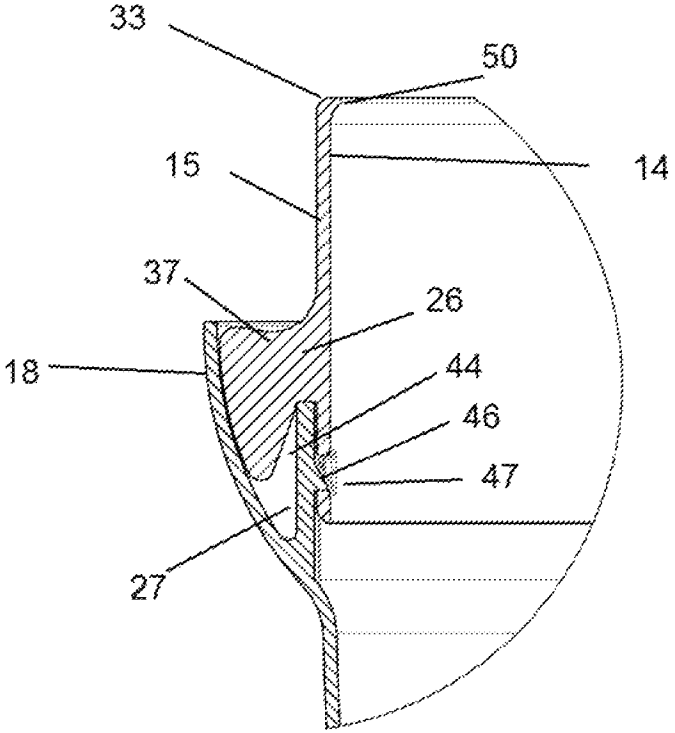
FIG. 14*b* is a close up view of the connection between the tubular member and the main body of the paint container of FIG. 14*a* through the line B-B.
Figure 14A:
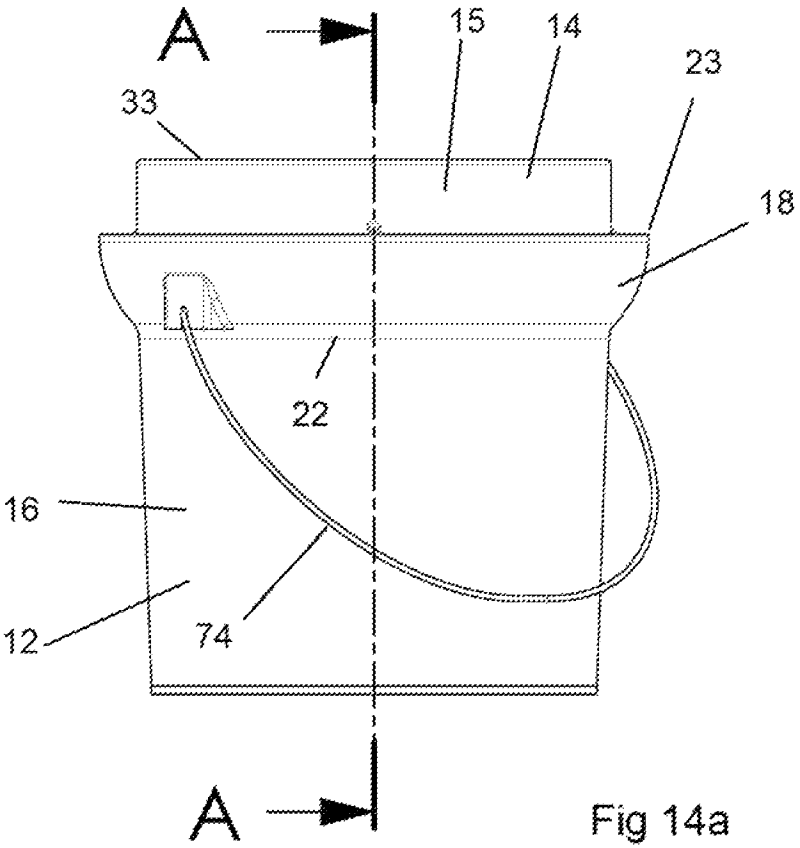
FIG. 14*a* is a side view of the paint container of FIG. 13.

FIGS. 13 and 14 show a fifth embodiment of a paint container 10. In accordance with the present invention. The paint container 10 of FIGS. 13 and 14 is similar to the previous embodiments and like reference numerals are used to denote like parts. The first connectors 26 comprise projections 37 and the second connectors 27 include channels 36, however different configurations for the first and second connectors 26 and 27 are provided. The projections 37 are generally planar, however the channels 36 do not include the slots. Instead, the projections 37 include a recess 44 to be received over the edge of the channel 36. Also, outer surfaces of the channels 36 include tabs 46 provided to engage into corresponding slots 47 provided in the cylindrical member 15, to hold the cylindrical member 15 in place.

In the embodiment of FIGS. 13 and 14, the upper end of the cylindrical member 15 also includes a lip 50 (as seen in FIG. 13*b*). This lip 50 is provided to increase the likelihood that paint removed from a brush will flow into the cylindrical member 15.

It will be readily apparent to persons skilled in the relevant arts that various modifications and improvements may be made to the foregoing embodiments, in addition to those already described, without departing from the basic inventive concepts of the present invention.

What is claimed is:

1. A paint container comprising:

a main body for receiving paint, the main body comprising a side wall and an outwardly tapering rim portion at an upper end of the side wall, the outwardly tapering rim portion defining an opening into which paint can be poured;

a tubular member, a lower end of which is receivable within the outwardly tapering rim portion;

first connectors provided on an outer surface of the tubular member; and second connectors provided on an inner surface of the outwardly tapering rim portion;

wherein one of the first or second connectors comprises a protruding portion including a vertical channel therein, wherein the protruding portion protrudes into the opening defined by the outwardly tapering rim portion, and the other of the other of the first or second connector comprises a projection extending vertically such that the projections are received into ends of the channels as the tubular member is moved downwardly into the outwardly tapering rim portion such that the tubular member is supported within the outwardly tapering rim portion to define an annular aperture between the lower end of the tubular member and the main body of the paint container.

2. The paint container in accordance with claim 1, wherein the first connectors engage with the second connectors by movement of the tubular member towards the main body in a direction perpendicular to a central longitudinal axis of the main body.

3. The paint container in accordance with claim 2, wherein the first connectors each comprise the protruding portion including the vertical channel therein being open at a lower end and the second connectors each comprise the projections extending vertically upward such that the projections are received into lower ends of the channels as the tubular member is moved downwardly into the outwardly tapering rim portion.

4. The paint container in accordance with claim 3, wherein the projections include lugs on sides thereof adjacent the central longitudinal axis of the main body and the tubular member is provided with corresponding holes located within each of the channels such that the lugs engage into the holes to locate the tubular member relative to the main body.

5. The paint container in accordance with claim 2, wherein the second connectors each comprise the protruding portion including the vertical channel therein being open at an upper end and the second connectors each comprise the projections extending downward such that the projections are received into upper ends of the channels as the tubular member is moved downwardly into the outwardly tapering rim portion.

6. The paint container in accordance with claim 5, wherein the projections extend downwardly from an associated cover portion, the cover portions comprising a planar member extending outwardly from the outer surface of the tubular member such that the cover member extends over the upper end of the channel.

7. The paint container in accordance with claim 6, wherein the main body comprises a cylindrical vessel and the tubular member comprises a cylindrical member having a diameter such that the cylindrical member can be received in the opening defined by the outwardly tapering rim portion.

8. The paint container in accordance with claim 7, wherein the cylindrical member is received within the outwardly tapering rim portion such that the lower end of the cylindrical member is located adjacent the lower end of the outwardly tapering rim portion and an upper end of the cylindrical member is located above the upper end of the outwardly tapering rim portion.

9. The paint container in accordance with claim 7, wherein the outwardly tapering rim portion tapers outwardly from adjacent a lower end thereof to the adjacent an upper end thereof to a greater degree than the taper of the cylindrical side wall.

10. The paint container in accordance with claim 9, wherein the cylindrical member is of the same diameter as that of the main body adjacent the rim portion.

11. The paint container in accordance with claim 10, wherein an outer diameter of the main body adjacent the lower end is less than an inner diameter of the cylindrical member such that multiple paint containers may be placed in a stacked configuration.

12. The paint container in accordance with claim 11, wherein the cylindrical member is received within the outwardly tapering rim portion such that the lower end of the cylindrical member is located adjacent the lower end of the outwardly tapering rim portion and an upper end of the cylindrical member is located above the upper end of the outwardly tapering rim portion.

13. The paint container in accordance with claim 12, wherein the first and second connectors are located at equal angular spacings around the tubular member and the outwardly tapering rim portion.

14. The paint container in accordance with claim 13, wherein a handle is provided being connectable to the main body of the paint container and the outwardly tapering rim portion is provided with securing members on outer sides thereof to engage with the handle such that the handle may be supported in one or more angular positions relative to the main body.

15. The paint container in accordance with claim 14, wherein the securing members include a pair of first protrusions located adjacent the upper edge of the outwardly tapering rim portion above the connection between the handle and the outwardly tapering rim portion such that the handle may be engaged between the first pair of protrusions to locate the handle in a vertical position.

16. The paint container in accordance with claim 15, wherein a pair of second protrusions is provided one on either side of the pair of first protrusions such that the handle engages with either of the second protrusions to hold the handle at an angle between vertical and horizontal.

17. The paint container in accordance with claim 16, wherein the main body comprises a cylindrical vessel and the tubular member comprises a cylindrical member having a diameter such that the cylindrical member can be received in the opening defined by the outwardly tapering rim portion.

18. The paint container in accordance with claim 1, wherein an outer diameter of the main body adjacent the lower end is less than an inner diameter of the cylindrical member such that multiple paint containers may be placed in a stacked configuration.

19. The paint container in accordance with claim 1, wherein the first and second connectors are located at equal angular spacings around the tubular member and the outwardly tapering rim portion.

20. The paint container in accordance with claim 1, wherein a handle is provided being connectable to the main body of the paint container and the outwardly tapering rim portion is provided with securing members on outer sides thereof to engage with the handle such that the handle may be supported in one or more angular positions relative to the main body.

* * * * *